United States Patent [19]

Tobari et al.

[11] Patent Number: 5,038,075

[45] Date of Patent: Aug. 6, 1991

[54] TRAVELING-WAVE DEFLECTION SYSTEM IN A CATHODE-RAY TUBE WITH CONDUCTING CORE ON HELICAL CONDUCTOR.

[75] Inventors: Tsutomu Tobari, Matsudo; Osamu Akitsuki, Takasaki; Koshi Takano, Sagamihara, all of Japan

[73] Assignee: Iwatsu Electric Co., Ltd., Tokyo, Japan

[21] Appl. No.: 427,733

[22] Filed: Oct. 26, 1989

[30] Foreign Application Priority Data

Oct. 28, 1988 [JP] Japan ..... 63-273903
Nov. 18, 1988 [JP] Japan ..... 63-291892

[51] Int. Cl.[5] ..... H01J 29/74

[52] U.S. Cl. ..... 313/435; 313/437; 313/450; 315/3.6; 315/5.26

[58] Field of Search ..... 313/421, 423, 426, 432, 313/435, 437, 439, 450; 315/3, 3.6, 5.24, 5.26, 5.27

[56] References Cited

U.S. PATENT DOCUMENTS 3,376,464 4/1968 Loty et al. ..... 313/421 X
4,093,891 6/1978 Christie et al. ..... 313/421 X
4,988,929 1/1991 Spanjer et al. ..... 313/450

FOREIGN PATENT DOCUMENTS 52-13885 3/1952 Japan .
57-10539 2/1982 Japan .
155539 6/1988 Japan .

*Primary Examiner*—Donald J. Yusko
*Assistant Examiner*—John Giust
*Attorney, Agent, or Firm*—Woodcock, Washburn, Kurtz, Mackiewicz & Norris

[57] ABSTRACT

A traveling-wave deflection system comprising a pair of deflectors disposed opposite each other across the path of an electron beam from an electron gun to a screen in a cathode-ray tube. Each deflector has a helical conductor wound around a core structure generally extending along the beam path. If made solely of an insulating material as in the prior art, the core structures would be electrified in use of the CRT, with the consequent deflection defocusing and bright line displacement. Therefore, in order to avoid electrification, the core structures are each enveloped in an antielectrification layer of a conducting material having a higher resistivity than the helical conductor. An embodiment is also disclosed wherein the core structures are wholly of conductive material.

16 Claims, 6 Drawing Sheets

TRAVELING-WAVE DEFLECTION SYSTEM IN A CATHODE-RAY TUBE WITH CONDUCTING CORE ON HELICAL CONDUCTOR.

BACKGROUND OF THE INVENTION

Our invention relates generally to cathode-ray tubes (CRTs) and particularly to a deflection system in a CRT. More particularly, our invention pertains to a traveling-wave deflection system of the type having a pair of helical conductors wound around core structures for deflecting a beam of electrons in a desired direction.

A typical conventional means for deflecting a beam of electrons in a given direction in a CRT comprises a pair of deflector plates positioned opposite each other across the beam path. The deflector plates will deflect the electron beam to an extent proportional with the magnitude of the deflecting voltage applied therebetween. This statement holds true, however, only when the deflecting voltage magnitude remains the same during the passage of the electrons through the deflecting electric field. The deflector plates will be incapable of providing the desired beam deflection if the frequency of the deflecting voltage is so high that the voltage magnitude changes during the passage of the electrons through the deflecting field.

A knonw solution to this problem is the traveling-wave deflection system comprising a deflecting waveguide of helical or other configuration which functions as a kind of delay circuit. The traveling speed of the electrons in a beam is approximately synchronized with that of the deflecting voltage from one end to the other of the waveguide. Thus, as the deflecting voltage acts on the electron beam for a longer period of time, desire deflection can be provided over a wide frequency range of the deflecting signal.

Japanese Patent Publication No. 57-10539, dated Feb. 26, 1982, represents a conventional device based on this priciple. This prior art device comprises a pair of opposed deflectors each having a helical conductor wound around an elongate core structure of electrically insulating material. We object to this conventional device because of the almost unavoidable electrification of the insulating core structure. The insulating core structure when electrified gives rise to deflection defocusing and bright line displacement.

Japanese Utility Model Publication No. 52-13885 proposes to reduce the electrification of the insulating core structures by creating grooves therein and hence by separating their exposed surfaces from the helical conductors. We again object to this known solution because the complete surfaces of the core structures facing the beam path cannot possibly be separated therefrom by creating grooves therein. Moreover, the core structures suffer a substantial decrease in mechanical strength if the grooves are cut therein deep enough to virtually eliminate the possibility of their electrification.

SUMMARY OF THE INVENTION

We have hereby invented how to protect the core structures from electrification in a traveling-wave deflection system of the type defined.

Briefly, our invention may be summarized as a CRT having an electron gun for producing a beam of electrons directed toward a target. More specifically, our invention resides in a traveling-wave deflection system included in the CRT and having a pair of deflectors disposed opposite each other across the path of the electron beam from the gun to the target for deflecting the beam in a preassigned direction. Each deflector of the traveling-wave deflection system comprises a core structure generally extending along the path of the electron beam, and a helical conductor wound around the core structure. At least part of the core structure, including its surface facing the beam path, is made of an electrically conducting material that has a higher resistivity than the helical conductor.

In a preferred embodiment the core structures of the traveling-wave deflection system are of insulating material and are each wholly enveloped by an antielectrification layer of a conducting material having a higher resistivity than the helical conductor. Each core structure may be considered to include the antielectrification layer as its constituent part. In an alternative embodiment, however, each core structure is wholly made of a conducting material, with the helical conductor wound directly thereon.

In all such embodiments the core structures are effectively protected against electrification during use of the CRT. Thus, despite the simplicity of means employed toward that end, the traveling-wave deflection system of our invention drastically reduces deflection defocusing and bright line displacement.

The above and other features and advantages of our invention and the manner of realizing them will become more apparent, and the invention itself will best be understood, from a study of the following description and appended claims, with reference has to the attached drawings showing some preferred embodiments of our invention.

DESCRIPTION OF THE PREFERRED EMBODIMENTS

Figure 1:
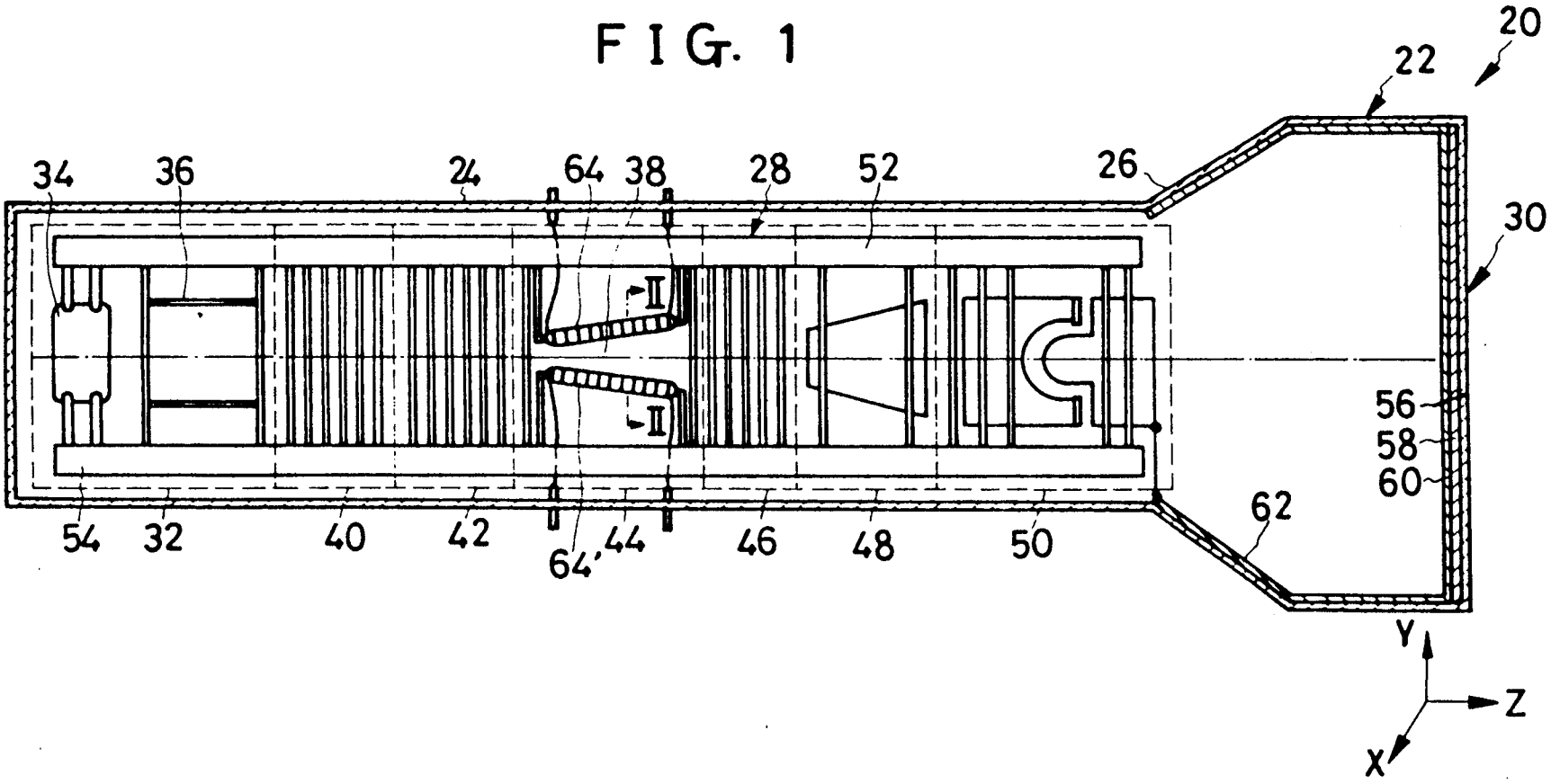
FIG. 1 is a longitudinal section through a cathode-ray oscilloscope incorporating the inproved traveling-wave deflection system of our invention for vertical beam deflection by way of an embodiment of the invention.

We will now describe the traveling-wave deflection system of our invention in detail as incorporated in the oscilloscopic CRT of generally conventional make illustrated in axial section in FIG. 1 and therein generally designated 20. The CRT 20 has an evacuated envelope 22 of suitable insulating material. The envelope 22 has a tubular neck portion 24 and funnel portion 26 of unitary construction. The neck portion 24 houses a gun-and-electrode assembly 28. The funnel portion 26 has a target or fluorescent screen 30 on its front end which is shown directed to the right in FIG. 1.

The gun-and-electrode assembly 28 includes an electron gun 32 comprised of a cathode and-control-grid subassembly 34 and an anode 36. The electron gun 32 emits electrons in a beam directed toward the fluorescent screen 30. We have indicated the path of the undeflected electron beam by the reference numeral 38. Extending axially of the envelope 22, the undeflected beam path 38 may be thought of as being parallel to the Z-axis indicated in FIG. 1.

Additionally, the gun-and-electrode assembly 28 comprises a first 40 and a second 42 quadrupolar lens, a traveling-wave vertical deflection system 44 constituting the gist of our invention, a third quadrupolar lens 46, a horizontal deflection system 48, and a scan-expansion electron lens 50, which are arranged in that order along the beam path 38 from the electron gun 32 to the fluorescent screen 30. The vertical deflection system 44 and horizontal deflection system 48 deflects the electron beam in tow orthogonal directions, that is, along the Y- and X-axes which are perpendicular to each other and to the Z-axis. All the listed components 32, 40, 42, 44, 46, 48 and 50 of the gun-and-electrode assembly 28 are supported by and between a pair of common support beams 52 and 54 extending along the axis of the envelope neck portion 24.

The fluorescent screen 30 comprises a faceplate 56, a phosphor layer 58 and a conductive layer 60. The conductive layer 60 is joined directly to a postaccelerating electrode 62 lining the envelope funnel portion 26. Extending rearwardly from the periphery of the conductive layer 58, the postaccelerating electrode 60 terminates in the vicinity of the scan expansion lens 50.

All but the traveling-wave vertical deflection system 44 of the listed components of the CRT 20 are conventional in construction, arrangement and operation. No further description on the details of the CRT 20 is therefore considered necessary. We will now proceed to the detailed disclosure of the vertical deflection system 44 according to our invention.

The traveling-wave vertical deflection system 44 comprises a pair of opposed deflectors 64 and 64' spaced from each other in the Y-axis direction across the beam path 38. As will be noted from their enlarged cross-sectional representations given in FIG. 2, the pair of deflectors 64 and 64' are of identical construction. We will therefore describe only the upper deflector 64 in detail and identify the various parts of the lower deflector 64' merely by priming the reference numerals used to denote the corresponding parts of the upper deflector 64.

Figure 2:
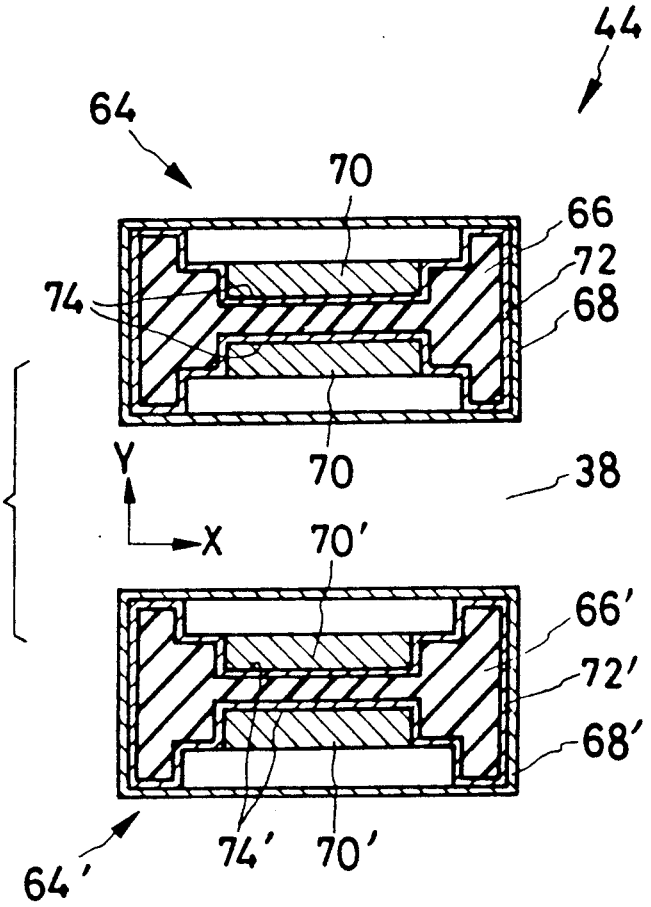
FIG. 2 is an enlarged cross section through the traveling-wave deflection system in the oscilloscope of FIG. 1, taken along the line II—II therein.
Figure 3:
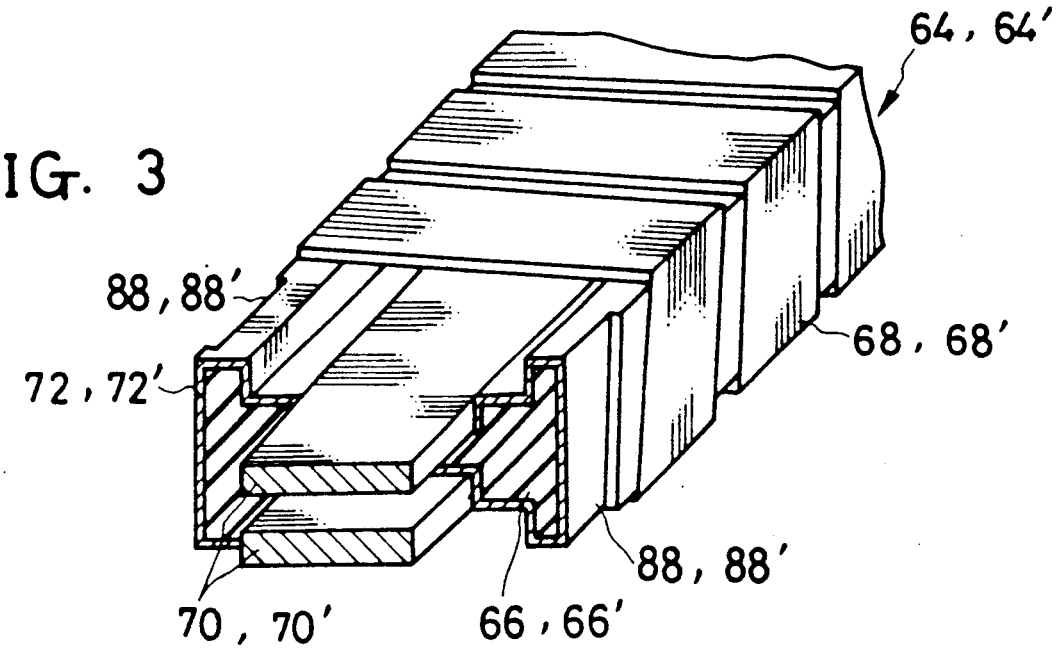
FIG. 3 is a fragmenatry perspective view of one of the pair of deflectors of the traveling-wave deflection system of FIG. 2, the other deflector being of identical make.

With reference to both FIGS. 2 and 3 the representative deflector 64 comprises an insulating core structure 66 generally extending along the beam path 38, a helical conductor 68 wound on the core structure, and a pair of grounding conductors 70.

The helical conductor 68 takes the form of a strip of sheet metal coiled helically around the core structure 66. This core structure must therefore be sufficiently rigid to support the helical conductor 68 in place thereon. The core structure 66 has an antielectrification layer 72 of conductive material formed on its entire surfaces in accordance with a feature of our invention. The antielectrification layer 72 may be formed by vapor deposition of a conductive substance such as ruthenium oxide. Alternatively, a coating of a conductive paste may first be formed on the core structure 66, either by screen printing or brushing, and the coating may then be fired.

The sheet resistance of the antieletrification layer 72 should be higher than that of the helical conductor 68. We recommend a range of $10^2$ to $10^9$ ohms per square. Should the sheet resistance of the antielectrification layer 72 be higher than that upper limit, it would not provide the desired antielectrification effect. If its sheet resistance were less than the lower limit, on the other hand, then a leakage current would flow between the helical conductor 68 and the grounding conductors 70, with the consequent attenuation of the deflection signal.

The pair of grounding conductors 70 are each in the form of a strip of relatively thick sheet metal, with a sufficient mechanical strength to support the core structure 66 and the helical conductor 68. The grounding conductors 70 are closely engaged in grooves 74 formed longitudinally in the opposite sides of the core structure 66. We understand that the grounding conductors 70 are suitably grounded. Placed inside the helical conductor 68, the grounding conductors 70 coact therewith to form a traveling-wave propagation circuit.

Figure 4:
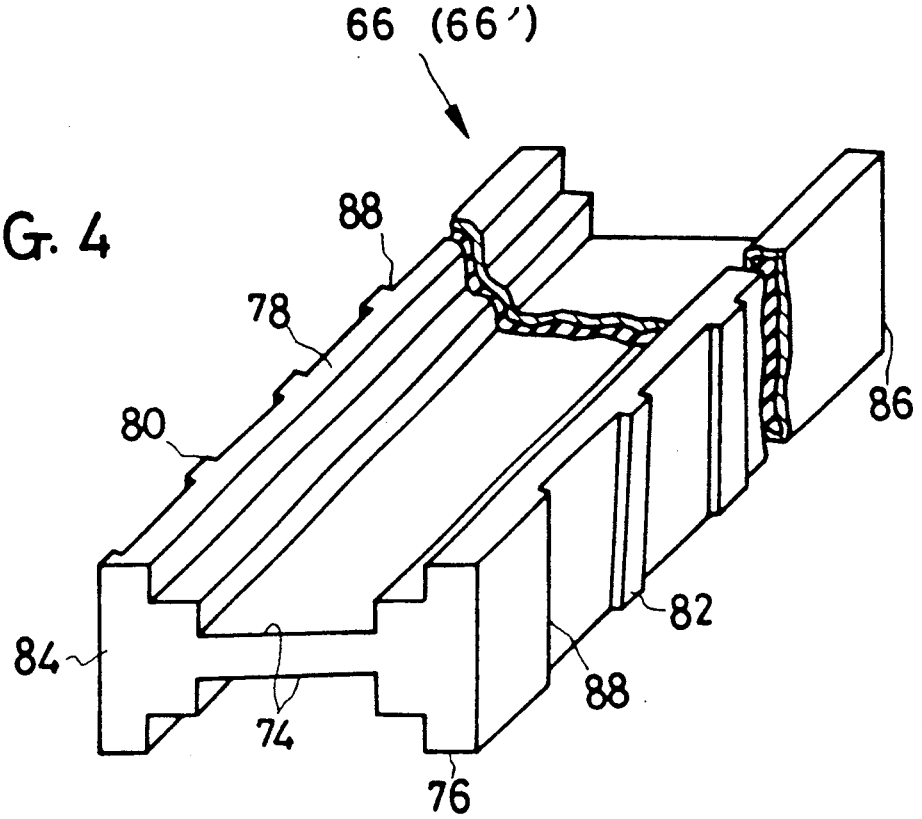
FIG. 4 is a perspective view, partly broken away for illustrative convenience, of the insulating core structure included in each deflector of the traveling-wave deflection system of FIG. 2.
Figure 5:
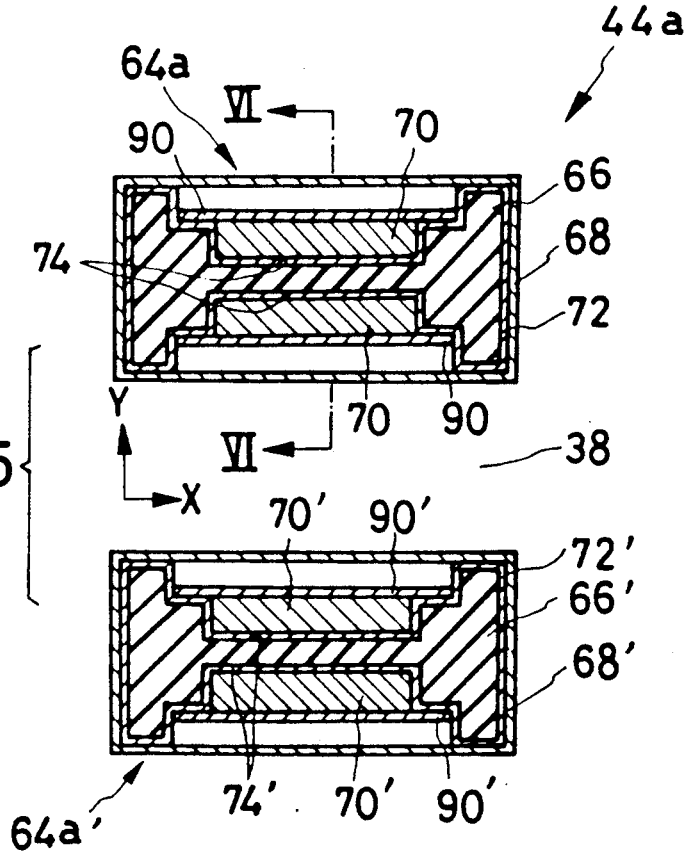
FIG. 5 is a view similar to FIG. 2 but showing another preferred form of traveling-wave deflection system according to our invention.

As illustrated by itself in FIG. 4, the insulating core structure 66 is essentially six-sided, having a first side 76 facing the beam path 38, a second side 78 directed away from the beam path, a third 80 and a fourth 82 side extending longitudinally between the first and second sides, and a fifth 84 and a sixth 86 side forming the opposite ends of the core structure. The noted grooves 74 for receiving the grounding conductors 70 are formed longitudinally in the first 76 and second 78 sides. Additional grooves 88 are defined in the third 80 and fourth 82 sides for receiving the helical conductor 68.

Operation

The characteristic impedance and phase velocity of the delay circuit comprised of the pair of deflectors 64 and 64' of the traveling-wave deflection system 44 are defined as:

$$Z_o = \sqrt{L/C\{(1 + C_oLw^2) + (C_oLw^2)^2 + \ldots} \quad (1)$$

$$V = \sqrt{1/LC - (C_o/C)W^2} \quad (2)$$

where $Z_0$=characteristic impedance of the delay circuit constituted of the deflectors 64 and 64'

L=inductance per turn of the helical conductors 68 and 68'

C=sum of twice the capacitance $C_1$ of each turn of the helical conductors 68 and 68' and the capitance $C_2$ between each helical conductor and the grounding conductors 70 and 70'

$C_0$=capacitance between every two adjacent turns of the helical conductors 68 and 68' w=angular frequency

V=phase velocity of the delay circuit.

The terms dependent on the angular frequency w in Equations (1) and (2) should be of as little magnitude as possible. Such terms can be reduced in magnitude as the $C_0$ can be reduced in the deflection system 44 of this embodiment. Also, since the $C_2$ can also be reduced, a greater latitude is allowed in designing the deflection system 44.

It will also be appreciated that the antieletrification layers 72 and 72' enveloping the insulating core structures 66 and 66' prevent their electrification in use of the CRT 20. The CRT will therefore suffer practically no defocusing or bright line displacement due to that cause.

Second Form

We have illustrated in FIGS. 5–8 an alternative form of traveling-wave deflection system **44*a* for use in the CRT 20 of FIG. 1 in substitution for the deflection system 44 disclosed above. As will be noted from FIG. 5, the alternative deflection system 44*a* also comprises a pair of deflectors 64*a* and 64*a'* of identical construction. We will therefore describe only the deflector 64*a* in detail and designate the various parts of the other deflector 64*a'* by priming the reference characters used to denote the corresponding parts of the deflector 64*a***.

Figure 8:
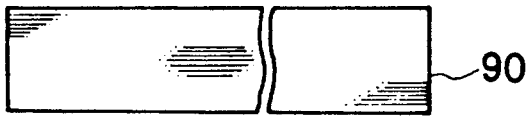
FIG. 8 is a plan view of one of the impedance corrector plates included in the traveling-wave deflection system of FIG. 5.

The representative deflector **64*a* features a pair of impedance correctors 90, each in the shape of an elongate, rectangular plate as pictured in FIG. 8, for compensating for the decreases of the characteristic impedance at the opposite extremities of the helical conductor 68. Placed in the longitudinal grooves 74 in the insulating core structure 66, the impedance correctors 90 are each held against one of the pair of grounding conductors 70 and spaced from the helical conductor 68. The other constructional details of the deflector 64*a* can be substantially as previously set forth in reference to the FIGS. 1–4 deflector 64**.

We have employed the impedance correctors 90 in order to make constant the characteristic impedance of the deflector **64*a* throughout its length. Were it not for the impedance correctors 90, the characteristic impedance would decrease toward the opposite extremities of the helical conductor 68 as a result of reduced inductance. The impedance correctors 90 are intended to compensate for such drops in the characteristic impedance by decreasing the capacitance of the helical conductor 68** in the vicinities of the extremities of the helical conductor.

Figure 6:
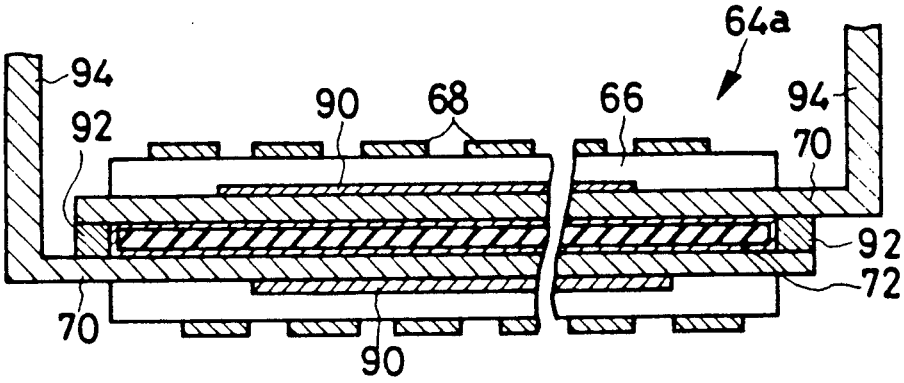
FIG. 6 is a longitudinal section through one of the pair of deflectors of the traveling-wave deflection system of FIG. 5, taken along the line VI—VI therein, the other deflector being of identical make.
Figure 7:
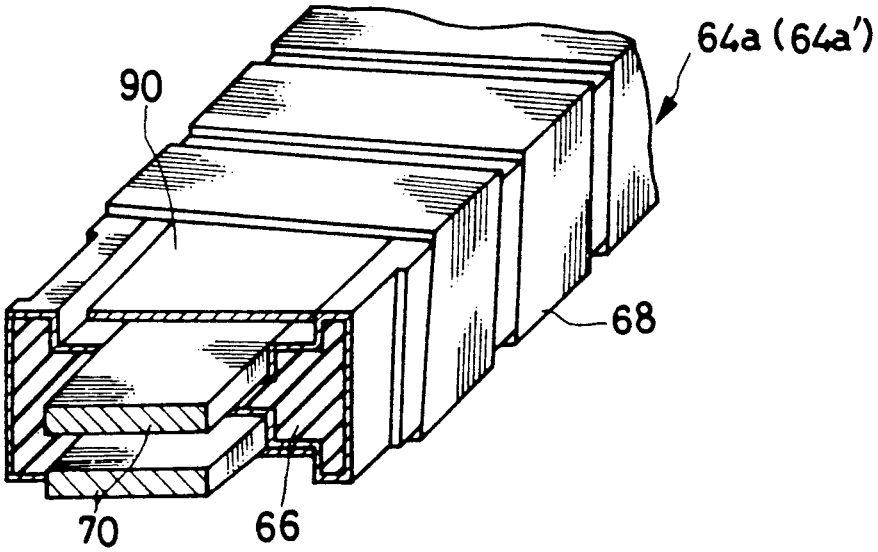
FIG. 7 is a fragmentary perspective view of the deflector of FIG. 6.

Accordingly, as best revealed by FIG. 6, each impedance corrector 90 does not extend throughout the length of the helical conductor 68 but terminates short of its opposite end portions. The length and placement of the impedance correctors 90 should be so determined that the capacitance between the helical conductor 68 and the combination of the grounding conductors 70 and the impedance correctors 90 becomes less at the opposite end portions of the helical conductor than at its midsection. The rate of decrease of the capacitance should closely approximate the rate of decrease of the inductance of the helical conductor 68 toward its opposite extremities. The constant characteristic impedance throughout the length of the helical conductor 68 results in the provision of a less reflective propagation path.

FIG. 6 additionally illustrates that the pair of grounding conductors 70 are electrically interconnected at its opposite ends by a pair of metal-made connective members 92, not only in this deflection system **44*a* but also in the FIGS. 1–4 deflection system 44. It will also be observed from FIG. 6 that each grounding conductor 70 has an extension 94 bent right-angularly from one end thereof for connection to one of the pair of support beams 52 and 54 of FIG. 1**.

Third Form

Figure 9:
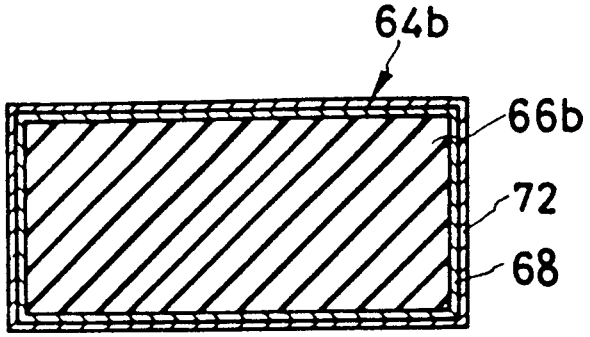
FIG. 9 is a cross section through one of the pair of deflectors making up still another preferred form of traveling-wave deflection system according to our invention.

FIG. 9 shows a cross section through still another preferred form of deflector **64*b* which in combination with another similar deflector, not shown, makes up a third form of traveling-wave deflector system for use in the FIG. 1 CRT 20. The deflector 64*b* has an insulating core structure 66*b* of the same rectangular cross-sectional shape throughout its length. Unlike the core structures 66 of the deflectors 44 and 44*a* this core structure 66*b* has no grooves for receiving the grounding conductors or the impedance correctors of the foregoing embodiments. The core structure 66*b* is thoroughly enveloped by the antielectrification layer 72. The helical conductor 68 is wound on the core structure 66*b* in direct contact with the antielectrification layer 72. The sheet resistance of the antielectrification layer 72 is set in the range of $10^3$ to $10^5$ ohms per square, which is higher than that of the helical conductor 68**.

Since the deflector **64*b* has no grounding conductors, there is no capacitive coupling between the helical conductor 68 and such grounding conductors. Consequently, as the magnitude of the above defined $C_2$ becomes less, so does the magnitude of the C in Equations (1) and (2). The insulating core structure 66*b*** is prevented from electrification as in the foregoing embodiments.

Fourth Form

Figure 10:
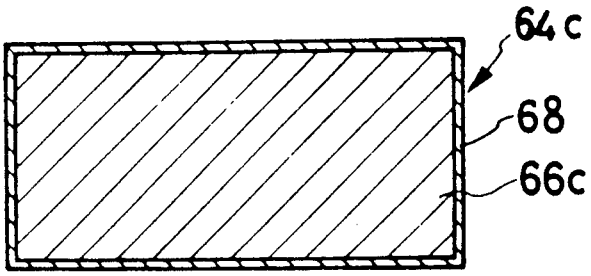
FIG. 10 is a cross section through one of the pair of deflectors making up yet another preferred form of traveling-wave deflection system according to our invention.

FIG. 10 is a cross-sectional representation of a further preferred form of deflector **64*c* to be combined with another similar deflector to make up a fourth form of traveling-wave deflection system for use in the FIG. 1 CRT 20. The deflector 64*c* features an electroconductive core structure 66*c* around which the helical conductor 68 is wound directly. A boron nitride complex is a preferred material of the conductive core structure 66*c*. The volumetric resistivity of the core structure 66*c* should be higher than that of the helical conductor 68, preferably from $10^3$ to $10^9$ ohm-centimeters. So constructed, the deflector 64c offers the same advantageous effects as the FIG. 9 deflector 64b**.

Fifth Form

Figure 11:
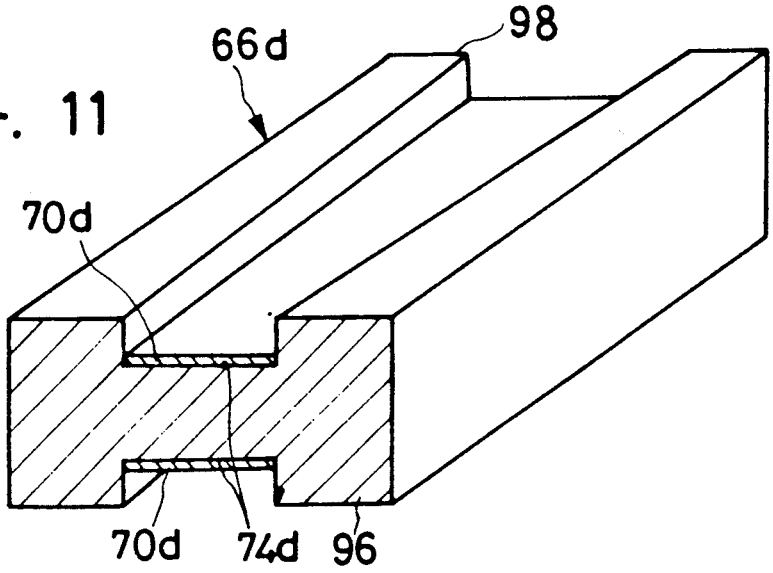
FIG. 11 is a partial perspective view of a modification of the core structure of each deflector of the traveling-wave deflection system according to our invention.

In FIG. 11 is shown a core structure 66d as a modification of the core structure 66 of the FIGS. 1-4 deflection system 44. The modified core structure 66d features a pair of grooves 74d formed in its opposite sides, as well as a pair of grounding conductors 70d received therein. Each groove 74d gradually increases in width from the beam entrance end 96 toward the beam exit end 98 of the core structure 66d. The grounding conductors 70d are of matching shape and size.

As will be seen by referring back to FIG. 1, the spacing between the pair of deflectors 64 and 64' of the traveling-wave deflection system 44 increases in the traveling direction of the electron beam. The modified core structure 66d with the modified grounding conductors 70d can compensate for the resulting decrease in the capacitance between the pair of deflectors.

Sixth Form

Figure 12:
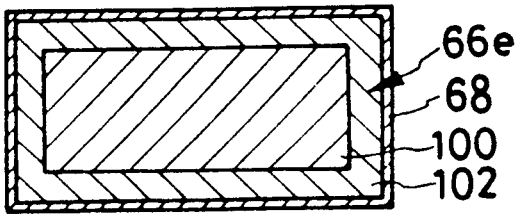
FIG. 12 is a cross section through one of the pair of deflectors constituting a further preferred form of traveling-wave deflection system according to our invention.

Another modified core structure 66e of FIG. 12 is cross-sectionally constituted of a central region 100 of a conductive substance, having a resistivity of, say, from 10 to $10^3$ ohm-centimeters, and a surrounding layer 102 of another conductive substance having a higher resistivity than that of the central region 100 and of the helical conductor 68. The deflection system incorporating this core structure 66e will gain the same advantages as those set forth in connection with the foregoing embodiments.

Seventh Form

Figure 13:
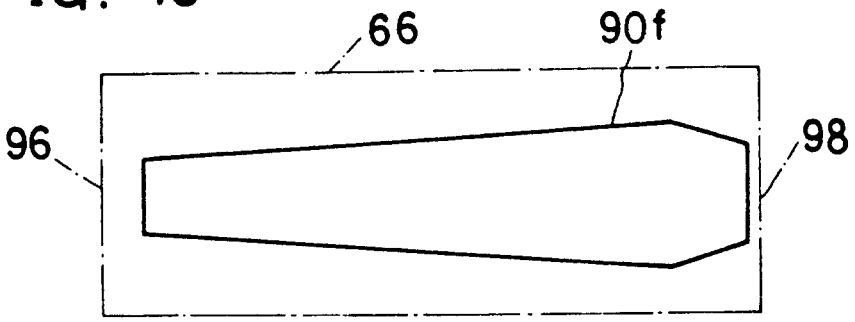
FIG. 13 is a plan view of a modified impedance corrector according to our invention.

FIG. 13 is an illustration of a modification of the impedance correctors 90 of the FIGS. 5-8 deflection system 44a. Each modified impedance corrector 90f generally increases in width from the beam entrance end 96 toward beam exit end 98 of the associated core structure 66 and briefly tapers at the beam exit end. This impedance corrector 90f is also effective to compensate for the change in the capacitance between the pair of deflectors 64 and 64' as they spread apart in the direction of beam travel as in FIG. 1.

Eight Form

Figure 14:
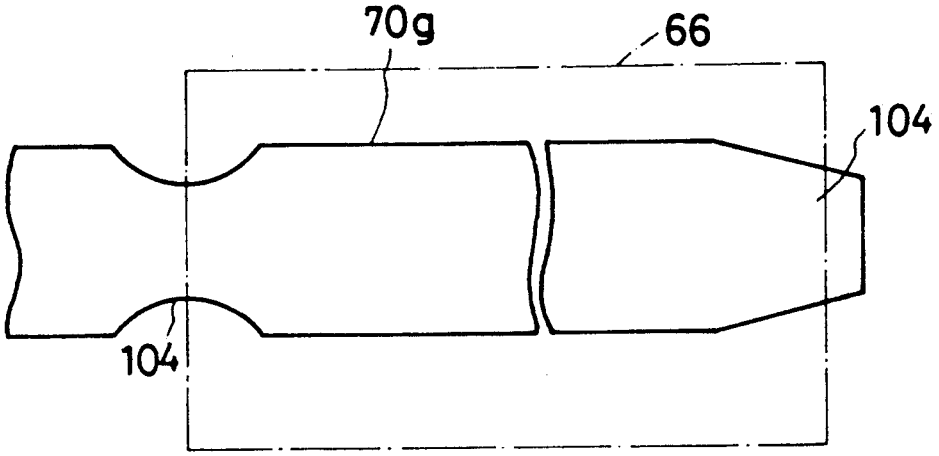
FIG. 14 is a plan view of a modified grounding conductor according to our invention.

A modified grounding conductor 70g of FIG. 14, which may be employed in substitution for each grounding conductor 70 of the FIGS. 1-4 deflection system 44, has portions 104 of reduced width which are opposed to the pair of opposite end portions of the helical conductor 68. The grounding conductor 70g of this modified shape serves to make constant the characteristic impedance of the associated helical conductor throughout its length.

Possible Modifications

Although we have shown and described our invention in terms of several preferable embodiments thereof, we understand, of course, that these embodiments are by way of example only and are not to impose limitations on our invention. The following, then, is a brief list of possible modifications and alterations of the above disclosed embodiments which we believe all fall within the scope of our invention:

1. Only one grounding conductor could be employed for each of the pair of deflectors 64 and 64' of the deflection system 44. The single grounding conductor might be embedded in each insulating core structure 66 or 66' which might be of laminar construction.

2. Each helical conductors could be formed by baking a coating of a conductive paint, by plating or by vapor deposition of a conductive substance, instead of by winding a strip of sheet metal.

3. The conductive core structure 66c of FIG. 10 could be of a ceramic or other material than a boron nitride complex.

4. The conductive layers 72 and 72' and the conductive layer 102 of FIG. 12 could be formed by firing a coating of a resistive paste.

5. The conductive layers 72, 72' and 102 could be formed only on those surfaces of the core structures which face the beam path and which therefore are most susceptible to electrification, although the creation of such layers on the complete surfaces of the core structures as in the illustrated embodiments may be easier.

6. In order to compensate for the variations in the capacitances of the helical conductors 68 and 68' as the pair of deflectors 64 and 64' spread apart in the direction of beam travel, a pair of suitable plate members could be disposed on those sides of the deflectors which are directed away from the beam path.

7. The invention is adaptable not only for the illustrated oscilloscope CRTs but also for storgage CRTs or storage tube.

What we claim is:

1. A cathode-ray tube having an electron gun for producing a beam of electrons directed toward a target, wherein the improvement resides in a traveling-wave deflection system having a pair of deflectors disposed opposite each other across the path of the electron beam from the gun to the target for deflecting the beam in a pre-assigned direction, each deflector of the traveling-wave deflection system comprising:

(a) a core structure generally extending along the path of the electron beam and having a surface facing the beam path;

(b) a helical conductor wound around the core structure;

(c) at lease part of the core structure, including the surface facing the beam path, being made of an electrically conductive material that has a higher resistivity than the helical conductor for the prevention of electrification in the core structure.

2. The invention of claim 1 wherein the core structure of each deflector is wholly made of the conductive material having a higher resistivity than the helical conductor.

3. The invention of claim 2 further comprising grounding conductor means mounted to the core structure of each deflector.

4. The invention of claim 2 wherein the core structure of each deflector has a resistivity ranging from $10^3$ to $10^9$ ohm-centimeters.

5. The invention of claim 1 wherein the core structure of each deflector is cross-sectionally comprised of:

(a) a central region of a first conductive substance; and (b) a layer of a second conductive substance surrounding the central region and having a higher resistivity than the first conductive substance and the helical conductor.

6. The invention of claim 5 wherein the first conductive substance has a resistivity ranging from 10 to $10^3$ ohm-centimeters.

7. A cathode-ray tube having an electron gun for producing a beam of electrons directed toward a target, wherein the improvement resides in a traveling-wave deflection system having a pair of deflectors disposed opposite each other across the path of the electron beam from the gun to the screen for deflecting the beam in a preassigned direction, each deflector of the traveling-wave deflection system comprising:

(a) a core structure of electrically insulating material generally extending along the path of the electron beam and having a surface facing the beam path;

(b) a helical conductor wound around the core structure; and (c) an antielectrification layer of electrically conducting material formed at least on that surface of the core structure which faces the beam path, the antielectrification layer having a higher sheet resistance than the helical conductor.

8. The invention of claim 7 wherein the antielectrification layer of each deflector thoroughly envelopes the core structures.

9. The invention of claim 7 wherein the antielectrification layer of each deflector has a sheet resistance ranging from $10^2$ to $10^9$ ohms per square.

10. The invention of claim 7 wherein each deflector further comprises grounding conductor means mounted to the core structure.

11. The invention of claim 10 wherein the core structure of each deflector has a groove formed logitudinally in that surface of the core structure which faces the beam path, and another groove formed longitudinally in another surface of the core structure facing away from the beam path, and wherein the grounding conductor means of each deflector comprises a pair of grounding conductor members engaged one in each of the grooves in the core surface.

12. The invention of claim 11 wherein the pair of grounding conductor members of each deflector are electrically connected to the antielectrification layer.

13. The invention of claim 11 wherein each grounding conductor member of each deflector is generally in the shape of a rectangular plate and is formed to include a pair of reduced width portions positioned opposite the pair of extremities of the helical conductor.

14. The invention of claim 11 further wherein each deflector further comprises a pair of impedance corrector members disposed one between each grounding conductor plate and the helical conductor and electrically connected one to each grounding conductor plate for making constant the characteristic impedance of the deflector throughout its length.

15. The invention of claim 14 wherein the dimension of each impedance corrector member in the direction of the beam path is less than the dimension of each helical conductor in the same direction.

16. The invention of claim 14 wherein each impedance corrector member of each deflector is generally in the shape of a rectangular plate and is formed to include a pair of reduced width portions positioned opposite the pair of extremities of the helical conductor.

* * * * *

UNITED STATES PATENT AND TRADEMARK OFFICE

CERTIFICATE OF CORRECTION

PATENT NO. : 5,038,075

DATED : August 6, 1991

INVENTOR(S) : Tobari et al.

It is certified that error appears in the above-identified patent and that said Letters Patent is hereby corrected as shown below:

Col. 1, line 28, change "knonw" to --known--.

Col. 3, line 48, change "tow" to --two--.

Col. 4, line 30, change "antieletrification" to --antielectrification--.

Col. 5, line 29, change "antieletrification" to --antielectrification--.

Col. 9, line 29, change "logitudinally" to --longitudinally--.

Signed and Sealed this

Twentieth Day of April, 1993

*Attest:*

MICHAEL K. KIRK

*Attesting Officer*

*Acting Commissioner of Patents and Trademarks*